US005912440A

United States Patent [19]

Murakami et al.

[11] Patent Number: 5,912,440

[45] Date of Patent: Jun. 15, 1999

[54] WOODEN STRUCTURE

[75] Inventors: Shoichi Murakami, Ibaraki; Kenji Sato, Utsunomiya; Eiji Shiba, Tokyo, all of Japan

[73] Assignee: Teijin Limited, Osaka, Japan

[21] Appl. No.: 08/959,015

[22] Filed: Oct. 28, 1997

[30] Foreign Application Priority Data

Nov. 14, 1996 [JP] Japan ..... 8-316909

[51] Int. Cl.[6] ..... E04H 17/00

[52] U.S. Cl. ..... 181/210; 52/144

[58] Field of Search ..... 181/210, 284, 181/286, 287, 290, 294, 295; 52/144, 145

[56] References Cited

U.S. PATENT DOCUMENTS 3,667,175 6/1972 Bjorksten ..... 52/144

3,936,035 2/1976 Weimar et al. ..... 181/210

*Primary Examiner*—Khanh Dang

*Attorney, Agent, or Firm*—Sughrue, Mion, Zinn, Macpeak & Seas, PLLC

[57] ABSTRACT

A structure comprising a group of wood columns (10) which are generally arranged in parallel such that any two adjacent wood columns (11) which are in flat surface contact with each other, tension members (20) consisting of a fiber-reinforced resin composite, which penetrate the group of wood columns (10) and clamp them in the arrangement direction such that the surface contact pressure between any two adjacent wood columns being from 2.0 to 28 kg/cm$^2$. The columns themselves are not damaged and gaps do not form between the columns in winter due to shrinking and elongation. The number of parts is small, the columns can be simply assembled and the cost of production can be kept down.

6 Claims, 3 Drawing Sheets

WOODEN STRUCTURE

BACKGROUND OF THE INVENTION

1. Field of the Invention

The present invention relates to a wooden structure in panel form which is manufactured from thinned lumber, particularly to a wooden structure in a panel form manufactured by utilizing thinnings.

2. Description of the Related Art

Thinned logs are lumber that is cut from an afforested area. The thinned logs typically have small annual rings and are predominately immature wood. As a result, their usefulness is limited due to their shape and quality. Attempts have been made, however, to use the thinned logs for sound insulating walls.

A sound insulating wall is constructed, for example, by the following procedure: logs from thinning are cut to have a given length; the opposing two sides are cut along the length of the thinned logs parallel to each other so as to form columns each having two parallel flat surfaces; the columns are arranged in parallel in such a manner that one flat surface of one of any two adjacent columns is contacted with a flat surface of the other one of the two columns; bolts are passed through respective penetrations provided in the columns and then sequentially clamped to give a panel; the panels thus obtained are allowed to stand continuously and vertically in a wall form (Japanese Unexamined Patent Publication Nos. 5-141022 and 7-305413).

However, since the sound insulating wall prepared by using logs from thinning is made of wood, the wall dries and shrinks in the winter, forming gaps between the columns. As a result, noise leaks through the gaps, and the sound insulating wall functions poorly as noise insulation. When the clamping force of the bolts is strengthened to overcome this disadvantage, the columns themselves are damaged and the durability of the sound insulating wall is significantly impaired.

On the other hand, an arrangement of coil springs between the panels and the respective bolts have been proposed. In this case, the elongation and shrinkage of the columns are absorbed by the elastic force of the coil springs. When the coil springs are used, the number of parts is consequently increased. This results in the assembly of the panel becoming very complicated with an increase in the production costs (Japanese Unexamined Patent Publication Nos. 6-200571 and 7-71080)

SUMMARY OF THE INVENTION

The present invention has been achieved in view of the problems associated with the conventional techniques as mentioned above. The present invention provides a wooden structure which does not cause damage to the columns themselves and does not form any gaps between the columns in the winter due to elongation and shrinking. Furthermore, the instant structure can be simply assembled due to the small number of parts and which subsequently keeps the production costs down.

The present invention provides a wooden structure comprising a group of wood columns which are generally arranged in parallel such that any two adjacent wood columns are in flat surface contact with each other; tension members consisting of a fiber-reinforced resin composite which penetrate the group of wood columns and clamp them in the arrangement direction, wherein a surface contact pressure between any two adjacent wood columns is from 2.0 to 28 kg/cm$^2$.

Since the surface contact pressure between any two adjacent wood columns is set at 2.0 to 28 kg/cm$^2$ as explained above, gaps are not formed among the wood columns in winter, and the wood columns themselves are not impaired.

DESCRIPTION OF THE PREFERRED EMBODIMENTS

Figure 1:
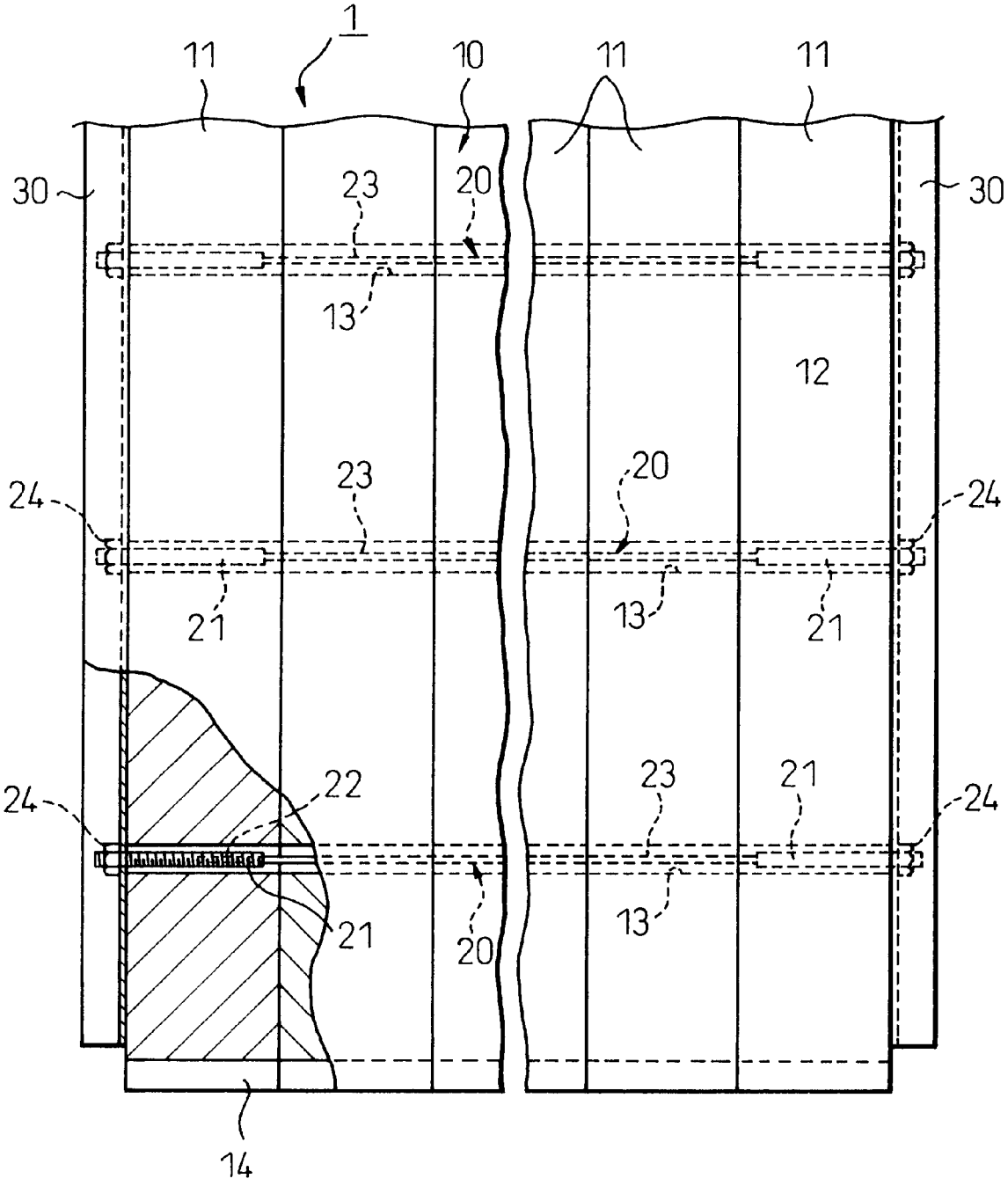
FIG. 1 is a plan view of a wooden structure according to the present invention, the plan view including a partial cross section thereof.
Figure 2:
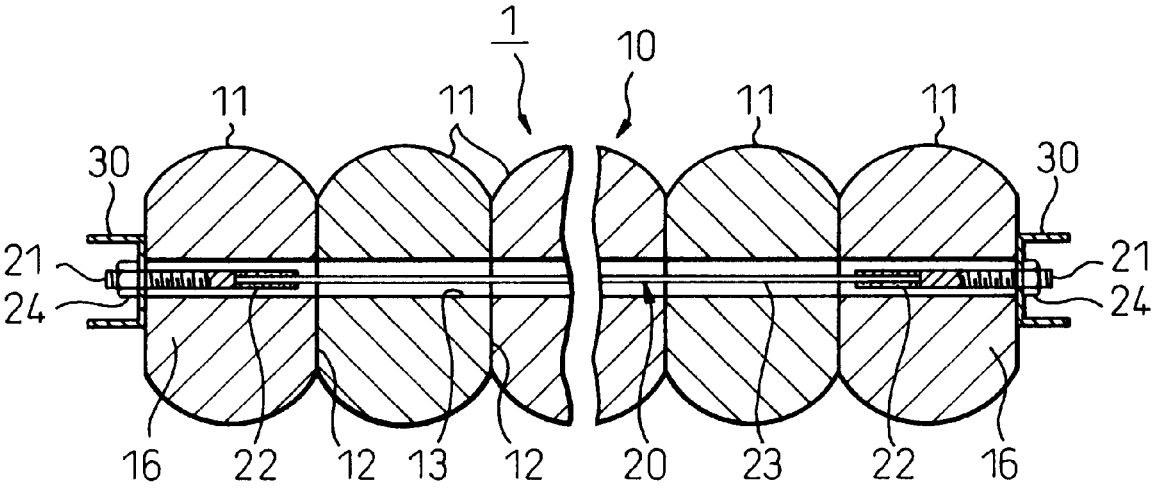
FIG. 2 is a cross sectional view along the line I1—I1 in FIG. 1.

The preferred embodiments of the present invention 10 will be explained with reference to the drawings. In addition, the explanation will be made by taking a sound insulating panel as an example. As shown in FIGS. 1 and 2, a wooden structure, namely a sound insulating panel 1 is mainly formed from a group of wood columns 10, tension members 20 and supporting metal fittings. The group of wood columns 10 are formed by arranging a given number of wood columns 11 in parallel. The wood columns 11 each have two parallel flat surfaces 12, 12 formed by cutting logs from thinning to have a given length, and cutting off two opposing sides in parallel of each of the logs from thinning using a sawmill not shown in the figures.

Figure 3:
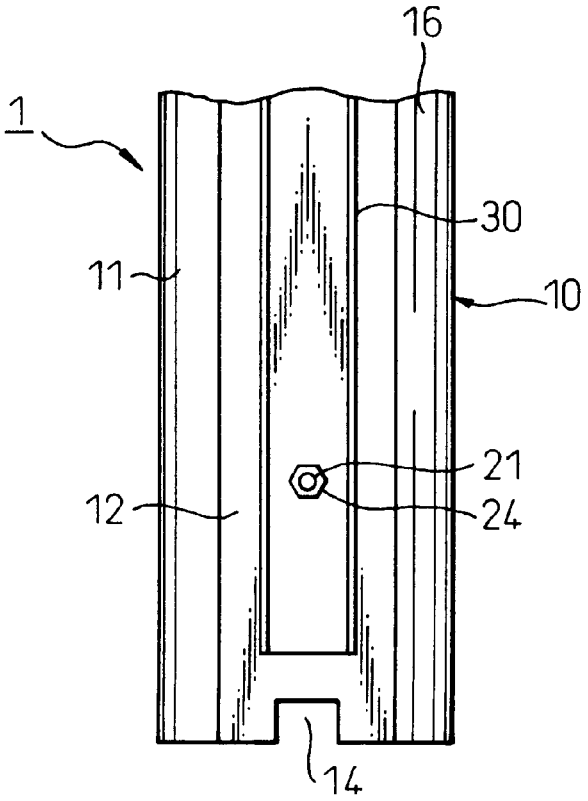
FIG. 3 is a side view of a wooden structure according to the present invention.

The group of wood columns 10 are formed by arranging a given number of the wood columns 11 in parallel in such a manner that one flat surface 12 of one of any two adjacent wood columns 1 is contacted with a flat surface 12 of the other one of the two columns. The wood columns 11 have a predetermined number of penetrations 13 at given intervals in the longitudinal direction which penetrations 30 penetrate the two flat surfaces 12, 12. Moreover, as shown in FIG. 3, the wood columns 11 have a groove 14 in the transverse direction at one longitudinal end thereof.

Two steel supporting metal fittings 30 each having an angular U-shaped cross section are applied to the respective ends of the group of wood columns 10, which are clamped with a given number of tension members 20 to be integrated and become in a panel form. That is, fiber-reinforced resin composites 23, to each of which two screw rods 21 as terminating members are bonded at the respective ends with an adhesive 22, are passed through the respective penetrations 13 of the wood columns 11 to form the group of wood columns 10. The screw rods 21 are subsequently passed through respective holes (not shown in the figure) provided in the supporting metal fittings 30 while the metal fittings 30 are being applied to the respective ends of the group of wood columns 10. Nuts 24 into which the respective screw rods 21 are screw-fitted are clamped with a predetermined force, whereby the wood columns 11 and the outermost supporting metal fittings 30 are integrated in a panel form.

During the integrating operation, the surface contact 15 pressure between any two adjacent wood columns 11, 11 must be from 2.0 to 28 kg/cm$^2$, preferably from 2 to 10 kg/cm$^2$, more preferably from 2 to 5 kg/cm$^2$. When the surface contact pressure between any two adjacent wood columns 11, 11 is less than 2.0 kg/cm$^2$ a gap may be formed between the two adjacent wood columns 11, 11 in winter due to the shrinkage of the wood columns 11. On the other hand, when the surface contact pressure between any two adjacent wood columns 11, 11 exceeds 28 kg/cm$^2$, the wood columns 11 themselves may be damaged, and the durability may be 25 impaired.

The surface contact pressure between any two adjacent wood columns 11, 11 is provided by clamping the nuts 24 until the nuts cannot be rotated while the group of wood columns 10 are being clamped with a predetermined clamping force from the transverse direction (arrangement direction). The clamping force (the surface contact pressure) is determined so that a value obtained by dividing the prestressed load by the area of the flat surface 12 of any wood column 11 becomes from 2.0 to 2835 kg/cm$^2$. Although the fiber-reinforced resin composites 23 are each bonded to the respective two screw rods 21 with an adhesive 22 in the above explanation, the composites each may also be bonded to the respective two screw rods 21, for example, by providing each of the screw rods 21 with a hole and a hook, combining each of the composites 23 with the respective screw rods 21 by utilizing the holes and hooks, and fixing the combined portion with the adhesive 22.

A composite obtained by impregnating a fiber bundle composed of aramide fibers, carbon fibers, polyvinyl alcohol fibers or glass fibers with a resin solution, and solidifying the bundle is desirable as the fiber-reinforced resin composite 23. The composite may have a tensile modulus of 2,000 to 25,000 kg/mm, preferably 3,000 to 15,000 kg/mm more preferably 4,000 to 7,000 kg/mm. The composite may be poor in strength when it has a tensile modulus of less than 2,000 kg/mm. Although the composite has no problem concerning its strength when it has a tensile modulus exceeding 25,000 kg/mm on the other hand, the unnecessarily high strength is uneconomical.

Figure 4:
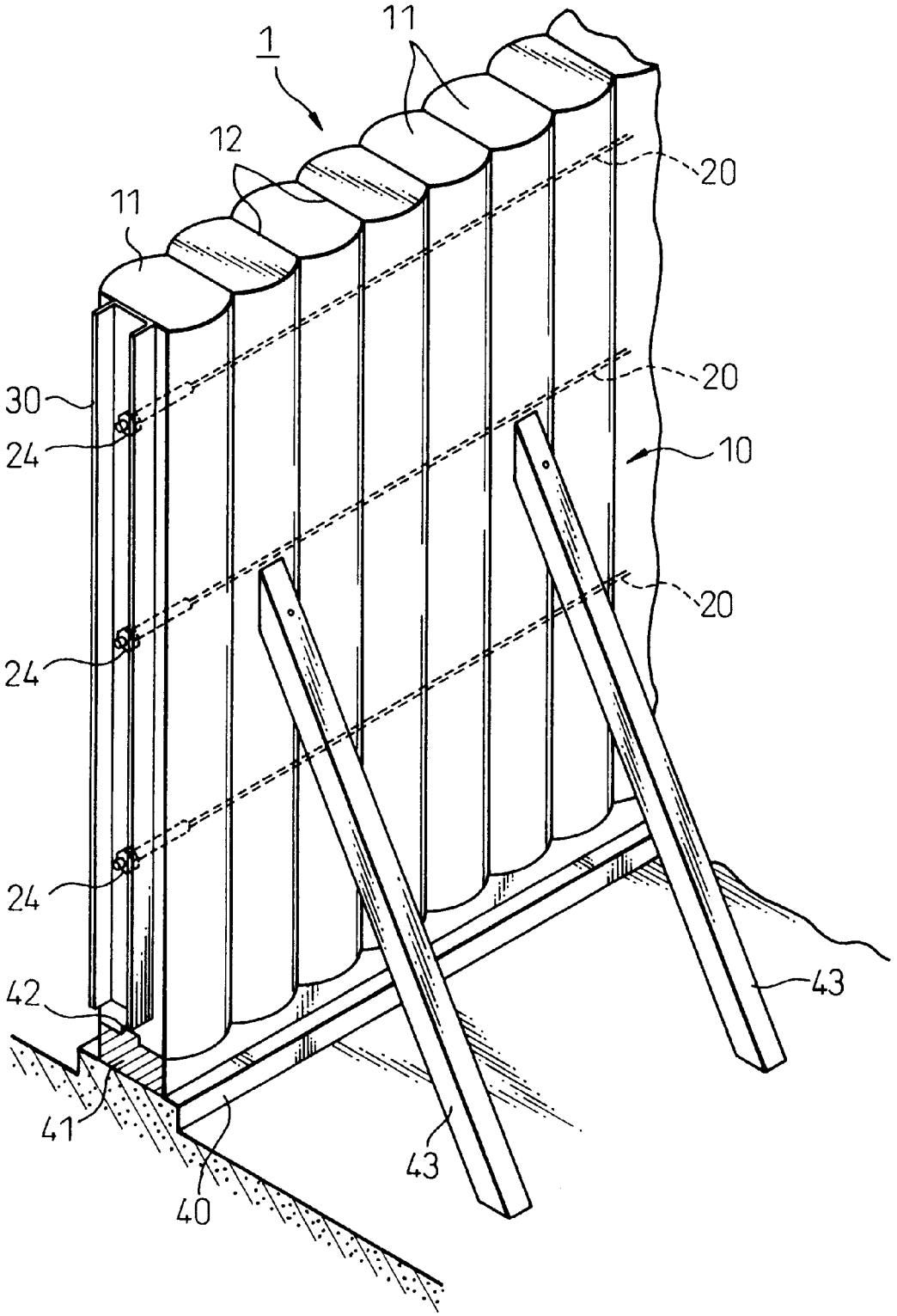
FIG. 4 is a perspective view of a sound insulating wall in which a wooden structure according to the present invention is used.

In order to prepare a sound insulating wall from the 20 panel 1, for example, as shown in FIG. 4, the panel 1 is allowed to stand on a sleeper 41 having a transverse cross section of a protruded shape and fixed on a foundation 40 made of iron rod-reinforced concrete with bolts. A protrusion 42 of the sleeper 41 is fitted into the groove 14 at one end of the wood columns 11. The back side of the panel 1 is held by supports 43 provided obliquely. In addition, the cost of the wooden structure can be reduced by omitting the groove 14 of the wood columns 11 and the protrusion 42 of the sleeper 41.

Although the above explanation has been made by taking the panel for a sound insulating wall as an example, the present invention is not limited thereto. The wooden structure of the present invention may also be utilized, for example, as a wall structure of a log house, and the like.

As explained above, in a wooden structure according to the present invention comprising a group of wood columns which are generally arranged in parallel, and any two adjacent wood columns of which are in flat surface contact with each other, and tension members which penetrate the group of wood columns in the arrangement direction and clamp them, the surface contact pressure between any two adjacent wood columns is set at from 2.02 to 28 kg/cm$^2$. Consequently, damage to the wood columns caused by an excessive clamping force can be prevented, and the formation of gaps among the wood columns in winter can be controlled. Moreover, the number of the parts is small, and the wooden structure can be simply assembled. Accordingly, the production costs can be kept down.

The present invention will be further illustrated with reference to the following non-limitative examples. Examples 1 to 3, Comparative Examples 1 and 2. Logs from thinning (diameter: about 13 cm) soon after cutting were each processed by cutting off the opposing two sides to give columns each having two parallel flat surfaces. As shown in FIGS. 1 and 2, the columns were arranged in parallel in such a manner that one flat surface of one of any two adjacent columns was contacted with a flat surface of the other one of the two columns. Furthermore, tension members consisting of a fiber reinforced resin composite were placed in respective penetrations provided in the columns, and the columns were clamped with the tension members to give a panel structure. The following table shows the construction of the panel structure, and its initial properties and its properties observed after leaving the panel structure outdoors for one year.

In addition, the sound transmission loss was measured in accordance with JIS A1416. Furthermore, the materials of the tension members shown in the table are as follows: A: a composite of aramide fibers (trade. name of Technora T-240 (1,500 denier/1,000 filaments), manufactured by Teijin Ltd.) and a vinyl ester resin in a volume ratio of 65/35; B: a composite of carbon fibers (trade name of Pyrofil AS-30 (number of filaments of 10,000, in a tow form), manufactured by Mitsubishi Rayon Co., Ltd.) and an epoxy resin in a volume ratio of 65/35.

It is understood from the table that even after leaving the structure according to the present invention for a long time, no gaps are formed among the columns and the sound insulation effect of the structure can be maintained at a high level.

TABLE

| | | Ex. 1 | Comp. Ex. 1 | Comp. Ex. 2 | Ex. 2 | Ex. 3 |
|---|---|---|---|---|---|---|
| Wood column | Contact surface: width cm | 10 | 10 | 10 | 10 | 10 |
| | Contact surface: length (height) m | 3 | 3 | 3 | 3 | 3 |
| | Initial moisture content wt. % | 50 | 47 | 53 | 48 | 52 |
| Tension member | Material | A | A | A | B | B |
| | Diameter mm | 7.4 | 7.4 | 12.0 | 12.0 | 12.0 |
| | Tensile strength kgf/mm$^2$ | 200 | 200 | 200 | 180 | 180 |
| | Tensile modulus kgf/mm$^2$ | 5400 | 5400 | 5400 | 12000 | 12000 |
| Panel structure (initial) | Width/thickness m/cm | 4/13 | 4/13 | 4/13 | 4/13 | 4/13 |
| | Number of columns | 40 | 40 | 40 | 40 | 40 |
| | Number of tension members | 2 | 2 | 10 | 2 | 3 |
| | Prestressed load ton | 8 | 4 | 90 | 28 | 32 |
| | Surface contact pressure kgf/cm$^2$ | 2.7 | 1.3 | 30 | 9.3 | 10.7 |

TABLE-continued

| | | Ex. 1 | Comp. Ex. 1 | Comp. Ex. 2 | Ex. 2 | Ex. 3 |
|---|---|---|---|---|---|---|
| | Elongation of tension member % | 2.1 | 0.8 | rupt* | 1.0 | 1.0 |
| | Appearance | good | good | — | good | good |
| Panel | Moisture content | 10 | 10 | — | 10 | 10 |
| structure | Shrinkage % | 0.9 | 0.8 | — | 0.8 | 0.8 |
| (after one | Remaining load ton | 3.8 | 0 | — | 1.5 | 2.3 |
| year) | Gap | No | Yes | — | No | No |
| | Other appearance changes | No | No | — | No | No |
| | Sound transmission loss at 400 Hz dB | 33 | 24 | — | 32 | 33 |
| | Sound transmission loss at 1000 Hz dB | 38 | 28 | — | 37 | 37 |

Note: *rupt = rupture

We claim:

1. A wooden structure comprising (1) a group of wood columns comprising wood columns having at least two surfaces in their longitudinal direction and penetrations at given intervals in their longitudinal direction, and being arranged in parallel such that any adjacent two wood columns are in contact with each other through surface thereof and both ends of the group of wood columns provide two end surfaces;

(2) tension members consisting of a fiber-reinforced resin composite, and (3) two supporting fittings having holes, wherein (i) said two supporting fittings are applied to the two end surfaces respectively, and (ii) said tension members pass through said penetrations of wood columns and said holes of supporting fittings, and clamp the group of wood columns and the supporting fittings such that a surface contact pressure between any two adjacent wood columns is from 2.0 to 28 kg/cm$^2$.

2. The wooden structure according to claim 1, wherein a tensile modulus of the tension members is from 2,000 to 25,000 kg/mm$^2$.

3. The wooden structure according to claim 1, wherein fibers of the fiber-reinforced resin composites are aramide fibers, carbon fibers, polyvinyl alcohol fibers or glass fibers.

4. The wooden structure according to claim 1, wherein both ends of the tension members are each connected to a terminating members respectively.

5. The wooden structure according to claim 4, wherein the two terminating members are fixed to the respective ends of the wooden structure and respective two supporting metal fittings.

6. The wooden structure according to claim 1, wherein the wood columns are formed by cutting off a log from thinning such that they have at least two parallel flat surfaces in their longitudinal direction.

* * * * *